United States Patent [19]

Morimoto et al.

[11] Patent Number: 4,576,515

[45] Date of Patent: Mar. 18, 1986

[54] PIPE LAYING APPARATUS

[75] Inventors: Keiji Morimoto, Yokohama; Shuichi Satoh, Ibaraki; Yoshiyuki Iwai, Ibaraki; Osamu Ae, Ibaraki; Masao Suda, Tsuchira; Kiyoshi Tsuchiya, Ibaraki; Kojiro Ogata, Ishioka; Naoki Miyanagi, Ibaraki, all of Japan

[73] Assignees: Nippon Telegraph & Telephone Public Corp.; Hitachi Construction Machinery Co., Ltd., both of Tokyo, Japan

[21] Appl. No.: 533,744

[22] Filed: Sep. 19, 1983

[30] Foreign Application Priority Data

Sep. 20, 1982 [JP] Japan ..... 57-162130
Sep. 20, 1982 [JP] Japan ..... 57-162131

[51] Int. Cl.[4] ..... F16L 1/02
[52] U.S. Cl. ..... 405/184; 175/62
[58] Field of Search ..... 405/141, 147, 184; 175/62, 207, 209, 213

[56] References Cited

U.S. PATENT DOCUMENTS 3,778,107 12/1973 Haspert ..... 405/147 X
3,894,402 7/1975 Cherrington ..... 405/184
4,221,503 9/1980 Cherrington ..... 405/184

FOREIGN PATENT DOCUMENTS 29797 2/1982 Japan .

*Primary Examiner*—David H. Corbin
*Attorney, Agent, or Firm*—Antonelli, Terry & Wands

[57] ABSTRACT

A pipe laying apparatus having an excavator for performing excavation in the earth to form a substantially horizontally extending hole, with the excavator having connected to its trailing end a leading end of at least one underground pipe at least partially located in the horizontally extending hole, an injector for injecting a viscosity imparting liquid into the earth in which excavation is being performed by the excavator to produce viscosity imparting liquid containing soil particles. A propelling device positioned against a trailing end of the pipe and is located in a starting pit. The viscosity imparting liquid containing soil particles produced by the excavator and injector are conveyed rearwardly of the excavator past an outer periphery thereof and filled in an annular gap defined between the horizontally extending hole and the pipe while the excavator and pipe are advanced by the propelling device. A soil particle discharging device is located between the trailing end of the excavator and the leading end of the pipe and within the pipe for introducing into the pipe the viscosity imparting liquid conveyed rearwardly of the excavator past the outer periphery thereof and discharging the soil particles into the starting pit through the pipe.

12 Claims, 10 Drawing Figures

PIPE LAYING APPARATUS

BACKGROUND OF THE INVENTION

This invention relates to pipe laying apparatus, and, more particularly, to a pipe laying apparatus for laying pipes of a relatively small diameter underground.

Recently, for laying pipes of a small diameter of, for example, less than 800 mm, underground, a propulsion process has become more popular than an open-cut or open trench process. In the propulsion process a pipe to be laid underground is propelled by pushing trailing end thereof by propulsion means such as a hydraulic cylinder located in a starting pit, and moving the pipe forwardly while forcing the earth ahead of the pipe to be compacted to lay the pipe underground. This type of propulsion process is referred to as a compaction system; however, a disadvantage of the compaction system resides in the fact that the earth offers great resistance to the pipes to be laid that are moved forwardly because they are merely pushed at their trailing ends by the hydraulic cylinder, so that a propelling force of high magnitude is required to move the pipes forwardly. Moreover, since a large force is exerted on the pipes, the pipes are subject to being damaged. Also, the system offers the disavantage that it is low in directional precision because the pipes laid by this system might be displaced from the direction in which they are intended to move.

To avoid the aforesaid disadvantages, proposals have been made to use a propulsion process of a rotary excavation system in which pipes are propelled by means of a hydraulic cylinder while a hole is being excavated by a rotary excavator to lay the pipes underground. Japanese Patent Laid-Open No. 29797/82 describes a pipe laying apparatus having particular utility in carrying out the propulsion process of the rotary excavation system for laying pipes underground.

The apparatus described in the above-noted Japanese Publication comprises a hydraulic cylinder, serving as propulsion means, mounted in a starting pit, drive means for driving rotary excavating tools for rotation, and viscosity imparting means. An excavator is provided which includes an excavator main body rotatably supporting at its leading end the rotary excavating tools which have a greater outer diameter than pipes to be laid and are formed with a port for injecting a viscosity imparting liquid into the earth. The rotary excavating tools comprise excavating cutters and agitating blades. The pipes to be laid are connected at their leading end to the trailing end of the excavator main body and the trailing end of the pipes is positioned against the hydraulic cylinder. Extending through the interior of the pipes is a hollow rotary shaft for the rotary excavating tools formed in the interior with a passageway for the viscosity imparting liquid to flow therethrough. The rotary shaft is connected at one end thereof to the rotary excavating tools and at other ends thereof to the drive means for driving the rotary excavating tools and the means for supplying the viscosity imparting liquid, respectively. A pressure bearing frame for holding the pressure of the soil particles is mounted in an annular gap defined between a horizontally extending hole formed by excavation and the pipes to be laid at an end thereof which opens in the starting pit. The pressure bearing frame is formed with a discharge opening.

The drive means for the rotary excavating means and the means for supplying the viscosity imparting liquid are actuated resulting in a rotating of the rotary excavating tools to dig a hole by the excavating cutters while the viscosity imparting liquid is injected through the injecting port into the earth dug and broken into soil particles, so that the soil particles and the viscosity imparting liquid are mixed and agitated by the agitating blades to produce viscosity imparting liquid containing soil particles. Since the rotary excavating tools have a greater outer diameter than the pipes to be laid, and an annular gap is defined between a substantially horizontally extending hole formed by excavation and the pipes laid underground. The viscosity imparting liquid containing soil particles, produced in the vicinity of the rotary excavating tools, are conveyed rearwardly of the excavator by the pressure under which the viscosity imparting liquid is injected into the earth and the propelling force of the hydraulic cylinder exerted on the pipes. Thus, the viscosity imparting liquid is moved past an outer periphery of the excavator main body and through the annular gap and the discharge port, to be ejected into the starting pit. Meanwhile, the hydraulic cylinder has its piston rod extended to push the pipes forwardly in the earth as excavation is performed by the excavating tools. When the piston rod of the hydraulic cylinder reaches the end of its stroke, the piston rod is returned to a contracted position and a new pipe is connected to the trailing end of the pipes laid in the starting pit. The aforesaid operation is repeated to successively lay one pipe after another underground.

In the pipe laying apparatus of the aforesaid construction and operation, the earth is excavated to produce the viscosity imparting liquid in the forward end portion of the excavator main body. This offers the advantage that the resistance offered to the forward movement of the pipes by the earth is greatly reduced. Moreover, since the annular gap between the horizontally extending hole formed by excavation and the pipes is filled with the viscosity imparting liquid, friction between the pipes and the earth is greatly reduced. Thus, the pipe laying apparatus offers the advantages that the propelling force exerted in the pipes by the propulsion means can be reduced, damage to the pipes can be minimized because the force exerted is reduced, and directional precision can be improved, as compared with pipe laying apparatus of the compaction system.

One disadvantage of the last described pipe laying apparatus resides in that fact that, since the viscosity imparting liquid is conveyed through the annular gap between the horizontally extending hole formed by excavation and the pipes laid toward the starting pit, the annular gap increases in length when the number of pipes laid increases and the distance to be covered by the forward movement of the pipes becomes greater, so that the resistance offered to the viscosity imparting liquid moved rearwardly through the annular gap increases. Thus, it is necessary to increase the propelling force exerted by the propulsion means on the pipes to a level high enough to enable the viscosity imparting liquid to be conveyed toward the starting pit by overcoming the resistance offered to their movement through the annular gap, although it would not be necessary to increase the propelling force to the same level as that exerted on pipes in apparatus of the compaction system.

SUMMARY OF THE INVENTION

This invention has been developed for the purpose of avoiding the aforesaid problem of the prior art. Accordingly, the invention has as its object the provision of a pipe laying apparatus which is capable of laying pipes underground without requiring any increase in the propelling force even when the horizontally extending hole formed by excavation increases in length and the distance covered by the movement of the pipes laid becomes great.

According to the invention, there is provided a pipe laying apparatus comprising excavator means for excavating in the earth to form a substantially horizontally extending hole, with the excavator means having connected to a trailing end thereof a leading end of at least one underground pipe at least partially located in the horizontally extending hole, with injection means for injecting a viscosity imparting liquid into the earth in which excavation is being performed by the excavator means to produce viscosity imparting liquid containing soil particles. Propulsion means are positioned against a trailing end of the pipe and located in a starting pit whereby the viscosity imparting liquid produced by the excavator means and injector means are conveyed rearwardly of the excavator means past an outer periphery thereof and filled in an annular gap defined between the horizontally extending hole and the pipe while said excavator means and pipe are advanced by the propulsion means. A soil particle discharging means is located between the trailing end of the excavator means and the leading end of the pipe and within the pipe for introducing into the pipe the viscosity imparting liquid conveyed rearwardly of the excavator means past the outer periphery thereof and discharging the soil particles into the starting pit through the pipe.

Preferably, the pipe laying apparatus according to the invention further comprises pressure bearing frame means disposed adjacent the starting pit for closing the annular gap defined between the horizontally extending hole and the pipe at an end thereof disposed on the side of the starting pit to hold, under pressure, the viscosity imparting liquid filled in the annular gap.

Preferably, the pipe laying apparatus according to the invention further comprises detector means disposed adjacent the particle discharging means for measuring the pressure of the viscosity imparting liquid to maintain the pressure of the soil particles filled in the annular gap closed by the pressure bearing frame means over a predetermined level.

Preferably, the soil particle discharging means comprises soil particle pumping and conveying means located between the trailing end of the excavator means and the leading end of the pipe for introducing the viscosity imparting liquid into the pipe, and conduit means connected to the soil particle pumping and conveying means and extending through the pipe to the starting pit for discharging the introduced soil particles into the starting pit. The soil particle pumping and conveying means preferably comprises an outer shell casing connected between the trailing end of the excavator means and the leading end of the pipe, and pump means arranged in the outer shell casing, with the outer shell casing being formed with an inlet opening for introducing the viscosity imparting liquid to the pump means.

In a pipe laying apparatus wherein the excavator means comprises an excavator main body, and rotary excavating tools rotatably supported at a forward end of the excavator main mody and having an outer diameter greater than the outer diameter of the pipe, there is preferably further provided drive means arranged within the excavator main body and connected to the rotary excavating tools for driving the tools for rotation. Preferably, the outer shell casing is substantially in the form of a cylinder and substantially equal in outer diameter to the pipe.

Preferably, the pump means comprises a soil particle container secured in place in the outer shell casing and formed with a soil particle inlet port and a soil particle outlet port, closing means including closing cylinder means disposed for reciprocatory movement in the soil particle container across the soil particle inlet port for opening and closing the inlet port, pump piston means disposed for reciprocatory movement in the closing means in an axial direction thereof for pumping and conveying in the soil particle container, and fluid operated means for forwardly moving the closing means ahead of the pump piston means and forwardly moving the pump piston means after closing of the soil particle inlet port by the closing means thereby to force the soil particles out of the soil particle container, and thereafter moving the closing means and the pump piston means reawardly.

Preferably, the fluid operated means comprises first fluid cylinder means secured in the outer shell casing substantially coaxially with the soil particle container and formed with an inlet port and an outlet port for a working fluid, second fluid cylinder means connected at one end thereof to the closing means substantially coaxially therewith and at the other end thereof to first drive piston means disposed for reciprocatory movement in the first fluid cylinder means, and third fluid cylinder means connected at one end thereof to the pump piston means substantially coaxially therewith and at the other end thereof to second drive piston means disposed for reciprocatory movement in the second fluid cylinder means.

DETAILED DESCRIPTION OF THE PREFERRED EMBODIMENTS

Figure 1:
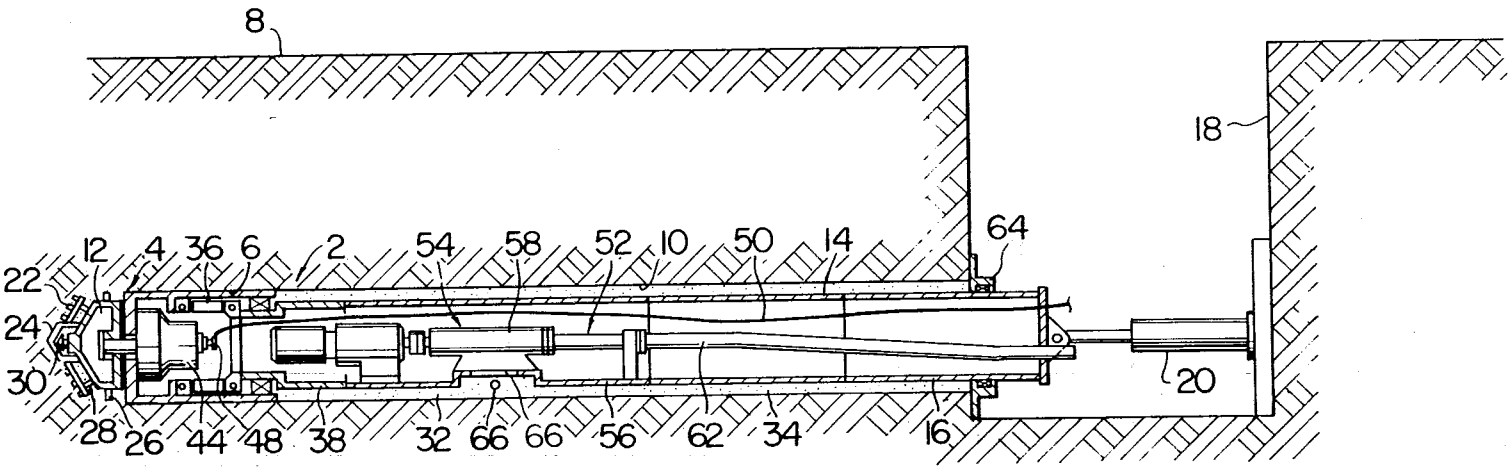
FIG. 1 is a partially cross-sectional side view of the pipe laying apparatus comprising one embodiment of the invention, showing the pipe laying apparatus in condition for operation in a substantially horizontally extending hole dug by excavation while its propulsion means is located in a starting pit.
Figure 2:
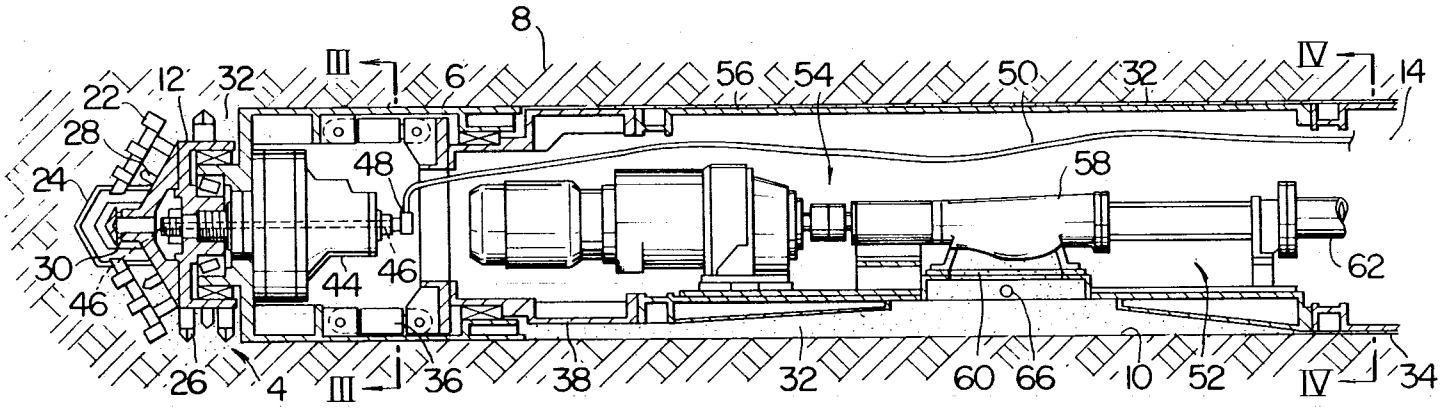
FIG. 2 is a partially cross-sectional side view, on an enlarged scale, of portions of the pipe laying apparatus shown in FIG. 1.
Figure 4:
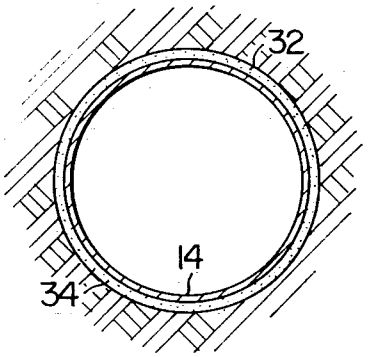
FIG. 4 is a sectional view taken along a line IV—IV in FIG. 2.

Referring now to the drawings wherein like reference numerals are used throughout the various views to designate like parts and, more particularly, to FIGS. 1–4, according to these figures, a pipe laying apparatus generally designated by the reference numeral 2 comprises an excavator generally designated by the reference numeral 4 including an excavator main body 6 of a substantially cylindrical shape, and rotary excavating tools 12 rotatably supported at a leading end of the main body 6 for performing digging in the earth 8 to form a substantially horizontally extending hole 10. The excavator 4 is connected at its trailing end to a leading end of at least one underground pipe located at least partially in the horizontally extending hole 10 or a leading end of a pipe 14 wholly located in the horizontally extending hole 10 and connected to a pipe 16 partially located therein, so that the excavator 4 will be advanced when the pipes 14 and 16 are pushed forwardly. The pipe 16 has, positioned against its trailing end, propulsion means which comprises a hydraulic cylinder 20 mounted in a starting pit 18.

The rotary excavating tools 12 comprise excavating cutters 22, 24 and agitating blades 26, 28 and are formed with an injector or port 30 for injecting a viscosity imparting liquid therethrough into the earth 8. As digging is performed in the earth 8 by the excavating cutters 22 and 24, the viscosity imparting liquid is injected through the port 30 into soil particles produced by excavation, and a mixture of the soil particles and the viscosity imparting liquid is agitated by the agitating blades 26 and 28 to produce viscosity imparting liquid 32 containing soil particles. The rotary excavating tools 12 have a larger outer diameter than the pipes 14 and 16, so that an annular gap 34 is defined between the horizontally extending hole 10, the pipes 14 and 16.

The excavator 4 further includes a direction correcting tube 38 connected to a trailing end of the main body 6 through direction correcting jacks 36. The direction correcting tube 38 is substantially equal in outer diameter to the pipes 14 and 16.

Figure 3:
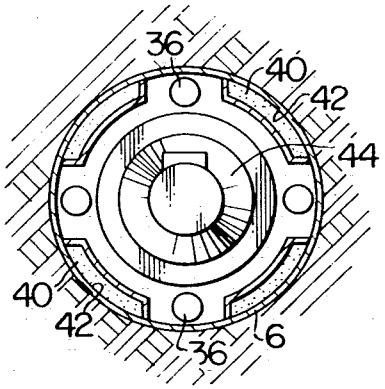
FIG. 3 is a sectional view, taken along a line III—III in FIG. 2.

The excavator main body 6 is substantially equal in outer diameter to the rotary excavating tools 12, and channels 40, opening at one end thereof in the rotary excavating tools 12 and at the other end thereof in the direction correcting tube 38, are alternately located between the jacks 36 in a peripheral portion of the main body 6. The viscosity imparting liquid 32 containing soil particles produced by the rotary excavating tools 12 are conveyed rearwardly of the excavator 4 through the channels 40. An outer shell 42, enclosing each channel 40 as shown in FIG. 3, may be dispensed with.

Mounted inside the excavator main body 6 is drive means 44 for driving the rotary excavating tools 12 for rotation, which comprises a hollow rotary shaft 46 supporting the rotary excavating tools 12 communicating at its forward end with the viscosity imparting liquid injecting port 30 and connected at its rearward end, through a swivel joint 48, to a forward end of a viscosity imparting liquid supply tube 50 which extends through an outer shell of a soil particle pumping and conveying means subsequently to be described, the pipes 14 and 16 and is connected to a viscosity imparting liquid supply device, not shown, which is located in the starting pit 18 or on the ground surface.

Located between the trailing end of the excavator 4 or a trailing end of the direction correcting tube 38 and the leading end of the pipe 14 and within the pipes 14 and 16 is soil particle discharging means 52 for introducing into the pipes 14, 16 the viscosity imparting liquid 32 conveyed rearwardly of the excavator 4 through the channels 40 and discharging same through the pipes 14 and 16 into the starting pit 18. The soil particle discharging means 52 comprises soil particles pumping and conveying means 54 located between the trailing end of the excavator 4 and the leading end of the pipe 14 for introducing into the pipes 14, 16 the viscosity imparting liquid containing soil particles 34 conveyed rearwardly of the excavator 4 through the channels 40. The soil particle pumping and conveying means 54 comprises an outer shell casing 56 connected between the trailing end of the excavator 4 and the leading end of the pipe 14, and a pump unit 58 located in the outer shell casing 56. The outer shell casing 56 is formed with an inlet opening 60 for introducing the viscosity imparting liquid 32 into a supply port of the pump unit 58. The outer shell casing 56 is substantially cylindrical in shape and substantially equal in outer diameter to the pipes 14, 16. The pump unit 58 has a discharge port communicated with a conduit 62 extending through the pipes 14, 16 to the starting pit 18. Thus, the viscosity imparting liquid 32, introduced through the inlet port 60 by the pump unit 58, is discharged through the conduit 62 into the starting pit 18.

The annular gap 34, defined between the horizontal hole 10 formed by excavation and the pipes 14, 16, is closed at an end thereof opening in the starting pit 18 by a pressure bearing frame 64 so that the pressure in the annular gap 34 is borne by the pressure bearing frame 54. A detector 66, for measuring the pressure of the soil particles, is located in the vicinity of the inlet port 60 of the soil particle pumping and conveying means 54 and produces a signal which is supplied to the pump unit 58 to control the same so that the pressure of the soil particles will not drop below a predetermined level.

The above-described embodiment of the pipe laying apparatus 2 as follows.

Actuation of the drive means 44 causes a rotation the rotary excavating tools 12 to dig the earth 8 by the excavating cutters 22, 24. Meanwhile, a viscosity imparting liquid 32 is supplied through the viscosity imparting liquid supply tube 50, swivel joint 48 and hollow rotary shaft 46 of the drive means 44 and injected through the port 30 into the earth 8. Soil particles and the viscosity imparting liquid 32 are mixed and agitated by the agitating blades 26 and 28 of the rotary excavating tools 12 to produce the viscosity imparting liquid 32 containing soil particles which are conveyed rearwardly of the excavator 4 by the pressure under which the viscosity imparting liquid is injected into the earth 8 and the propelling force exerted by the hydraulic cylinder 20. That is, the viscosity imparting liquid 32 is conveyed through the channels 40 in the excavator main body 6 and filled in the annular gap 34. Since the end of the annular gap 34, located on the side of the starting pit 18, is closed by the pressure bearing frame 64, the pressure under which the soil particles in the annular gap 34 are held rises as the volume of the soil particles increases. The pressure under which the soil particles are held is measured by the pressure detector 66 and when it reaches a predetermined level, the viscosity imparting liquid 32 are drawn by the pump unit 58 and passed through the conduit 62 in the pipes 14, 16 to be ejected into the starting pit 18. When the pressure under which the soil particles 32 in the annular gap 34 drops below the predetermined level, ejection thereof into the starting pit 18 is interrupted. In this way, the pipes 14, 16 can be successively laid underground while excavating the earth 8 by the excavator 4 and discharging the soil particles by the pump unit 58 into the starting pit 18. The pipe laying apparatus 2 according to the invention is distinct from pipe laying apparatus of the prior art in that the viscosity imparting liquid 32 containing soil particles is not conveyed through the annular gap 34 when discharged into the starting pit 18 but drawn by the pump unit 58 into the conduit 62 extending through the pipes 14, 16 laid underground and conveyed therethrough before being ejected into the starting pit 18. By virtue of this arrangement, the need to increase the propelling force exerted by the hydraulic cylinder 20 can be eliminated even if the distance converted by the movement of the pipes laid underground increases because the viscosity imparting liquid 32 passed through the conduit 62 extending through the pipes 14, 16 have nothing to do with the resistance offered to the forward movement of the pipes 14, 16 through the annular gap 34. The arrangement whereby the drive means 44 of the rotary excavating tools 12 is located in the excavator main body 6 eliminates the need to pass the rotary shaft for the excavating tools through the interior of the pipes 14, 16, thereby making it possible to mount, between the trailing end of the excavator 4 and the leading end of the pipe 14 and within the pipes 14, 16, the soil particle discharging means 52 comprising the pump unit 58 and the conduit 62.

Water may be used as a viscosity imparting liquid when the earth 8 is mainly formed of fine soil particles, and a bentonite solution may be used as a viscosity imparting liquid when it is mainly formed of coarse soil particles.

From the foregoing description, it will be appreciated that the pipe laying apparatus which is provided with the soil particle discharging means for introducing the viscosity imparting liquid 32 containing soil particles into the pipes 14, 16 and discharging the soil particles into the starting pit 18 through the pipes offers the advantage that the need to increase the propelling force exerted by the hydraulic cylinder 20 can be eliminated even if the distance covered by the forward movement of the pipes 14, 16 laid underground increases. Moreover, the soil particle discharging means can be mounted without any trouble between the trailing end of the excavator 4 and the leading end of the pipe 14 because the provision of the drive means 44 of the rotary excavating tools 12 in the excavator main body 6 eliminates the need to mount the rotary shaft for driving the rotary excavating tools 12 in the pipes 14, 16. In FIGS. 5–10, a pipe laying apparatus of generally designated by the reference numeral 70 is provided with soil particle discharging means 74 having soil particle pumping and conveying means 72 differing in construction from the corresponding means of the embodiment shown in FIGS. 1–4.

The pipe laying apparatus according to the invention has particular utility in laying pipes of relatively small diameter of less than, such as pipes of a diameter about 800 mm. The outer shell of the soil particle pumping and conveying means cannot have its outer diameter increased to an extent such that the annular gap between it and the horizontally extending hole formed by excavation disappears, and, in actual practice, its outer diameter is substantially equal to that of the pipes laid. Thus, when the pipes laid underground have an outer diameter of less than about 600 mm, the outer diameter of the outer shell of the soil particle pumping and conveying means would be similarly small and, consequently, the pump unit mounted therein would have to be small in size. Stated differently, in the pipe laying apparatus according to the invention, the size of the pump unit that can be utilized dictates the lower limit of the diameter of the pipes to be laid underground.

Meanwhile, the soil particles discharged by the pipe laying apparatus according to the invention might contain gravels, rocks or other solid particles greater in size than soil particles, so that the pump unit of the soil particle pumping and conveying means would have to be capable of pumping and conveying the soil particles mingled with such solid particles.

The pump unit used with the conduit as soil particles pumping and conveying means of the pipe laying apparatus according to the invention would thus have to meet the following two requirements: that the pump unit is so small that it can be mounted in an outer shell of substantially the same diameter as pipes of a small diameter and that it is powerful enough to positively convey under pressure the soil particles mingled with soil particles of larger diameter than the soil particles. The embodiment of the pipe laying apparatus shown in FIGS. 5–10 comprises soil particle pumping and conveying means having a pump unit capable of meeting the noted two requirements.

As shown in FIGS. 5–10, the soil particles pumping and conveying means 74 comprises an outer shell casing 76 connected between the trailing end of the excavator 4 and the leading end of the pipe 14 laid underground, and a pump unit 78 located inside the outer shell casing 76 which is formed with an inlet opening 80 for introducing the viscosity imparting liquid containing soil particles 32 into the interior of the outer shell casing 76. The outer shell casing 76 is substantially equal in outer diameter to the pipes 14, 16 laid underground, and the annular gap 34 is defined between the outer shell casing 76 and the horizontal hole 10 formed by excavation.

Figure 5:
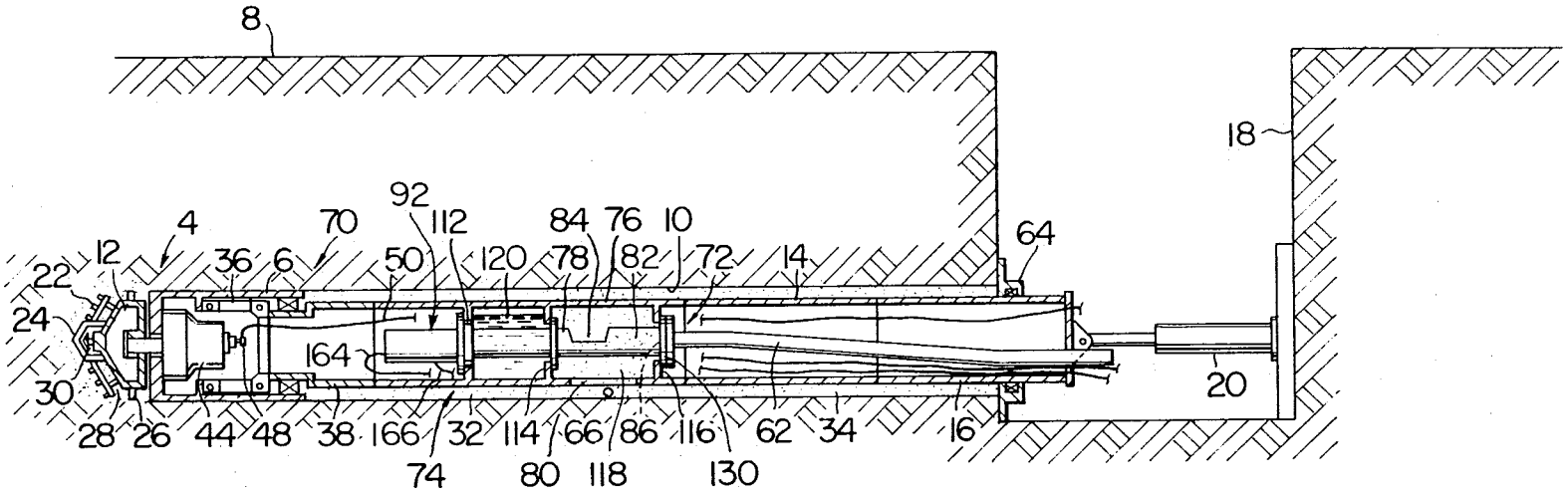
FIG. 5 is a partially cross-sectional side view of the pipe laying apparatus comprising another embodiment similar to FIG. 1.
Figure 6:
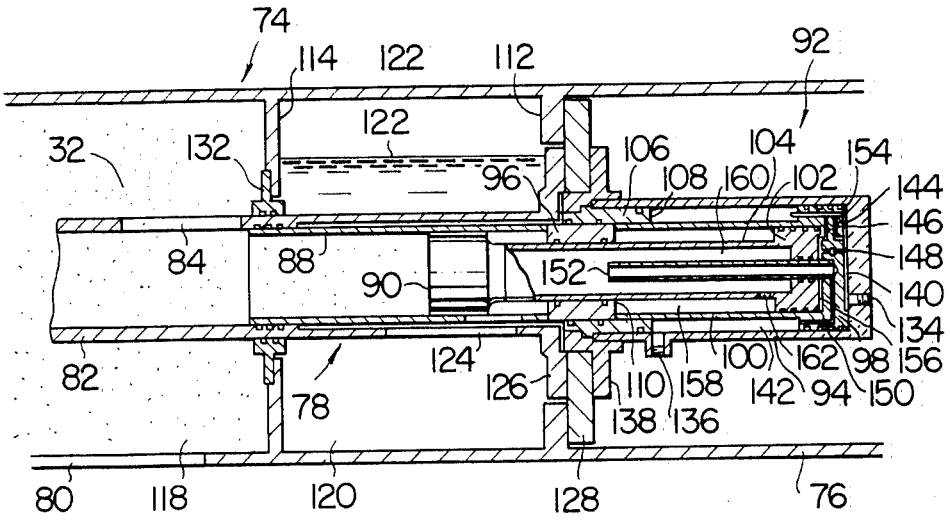
FIG. 6 is a sectional view, on an enlarged scale, of soil particle pumping and conveying means of the pipe laying apparatus shown in FIG. 5.

Referring to FIG. 6, the pump unit 78 has a soil particle conveying pipe 82 securedly fixed in the interior of the outer shell casing 76 to constitute a soil particle container. The soil particles conveying pipe 82 is formed at its peripheral wall with a soil particle inlet or supply port 84 and at one end thereof with a soil particle outlet or discharging port 86 (see FIG. 5) communicated with the conduit 62 for conveying the soil particles therethrough. Mounted in the soil particle conveying pipe 82 is a closing cylinder 88 movable in an axial direction across the supply port 84 in reciprocatory movement to open and close the same. Arranged in the closing cylinder 88 is a pump piston 90 movable therein in an axial direction in reciprocatory movement to force the soil particles out of the soil particle conveying pipe 82 into the conduit 62. Hydraulically operated means 92 is provided to actuate the closing cylinder 88 and pump piston 90 in such a manner that the closing means 88 is first actuated to move forwardly ahead of the pump piston 90 to close the supply port 84, the piston 90 is then actuated to move forwardly to force the soil particles out of the pipe 82 after the supply port 84 is closed, and thereafter the closing cylinder 88 and pump piston 90 are both moved rearwardly.

The hydraulically operated means 92 comprises a first hydraulic cylinder 94 secured to a rear end of the soil particle conveying pipe 82 and extending substantially coaxially therewith, a second hydraulic cylinder 100 of the same outer diameter as the closing cylinder 88 which extends coaxially therewith, the second hydraulic cylinder 100 being connected at one end thereof to the closing cylinder 88 through an annular sealing member 96 and at the other end thereof to a first drive piston 98 disposed for reciprocatory movement in the first hydraulic cylinder 94, and a third hydraulic cylinder 104 smaller in diameter than the piston 90 which extends coaxially therewith, the third hydraulic cylinder 104 being connected at one end thereof to the piston 90 and at the other end thereof to a second drive piston 102 disposed for reciprocatory movement in the second hydraulic cylinder 100.

The first hydraulic cylinder 94 has at its base an annular sealing member 106 which seals the second hydraulic cylinder 100 and allows same to move in sliding movement therein. The sealing member 106 is formed at an end thereof facing the first drive piston 98 with a stopper 108 for the piston 98. The third hydraulic cylinder 104 is sealed in the annular sealing member 96 and moves in sliding movement therein. The annular sealing member 96 is formed at an end thereof facing the second drive piston 102 with a stopper 110 for the piston 102.

As shown in FIGS. 5 and 6, the interior of the outer shell casing 76 is partitioned by partition walls 112, 114 and 116 into a soil particle reservoir 118 and an oil reservoir 120. The soil particle reservoir 118 stores therein the viscosity imparting liquid 32 containing soil particles conveyed past the outer periphery of the excavator main body 6 rearwardly thereof and introduced into the casing 76 through the inlet opening 80, and the oil reservoir 120 stores therein a lubricant 122 for lubricating sliding portions of the cylinders 88, 100 and 104 and the piston 90.

Referring to FIG. 6, the soil particles conveying pipe 82 is formed with the aforesaid soil particles supply port 84 in a portion thereof located in the soil particle reservoir 118 and with a lubricant supply port 124 in a portion thereof located in the oil reservoir 120. The soil particle conveying pipe 82 is secured in place in the outer shell casing 76 concentrically therewith in such a manner that it has at one end thereof a flange 126 mounted on the partition wall 112 through a mounting member 128 and it has at the other end thereof a flange 130 (see FIG. 5) mounted on the partition wall 116 while its central portion is mounted on the partition wall 114 through a mounting member 132.

Referring to FIG. 6 again, the first hydraulic cylinder 94 is formed with a first port 134 at its closed rearward end wall and a second port 136 at its peripheral wall portion. The cylinder 94 is secured to the partition wall 112 through the mounting member 128 and a mounting member 138 attached thereto and connected to the rearward end of the soil particle conveying pipe 83.

Figure 7:
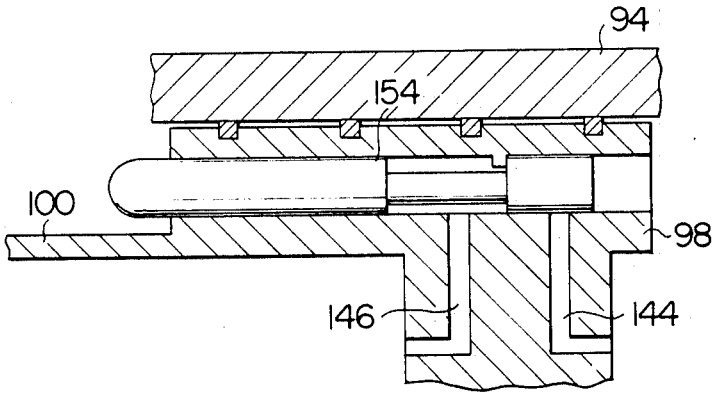
FIG. 7 is a sectional view showing, on an enlarged scale, the working fluid passageways of the pump unit of the pumping and conveying means shown in FIG. 6, and a spool for switching communication between the working fluid passageways.

The closing cylinder 88, which is actuated by the first drive piston 98, constitutes closing means for the soil particle supply port 84. A rear end face of the piston 98 and an inner surface of the rearward end wall of the first hydraulic cylinder 94 define therebetween a hydraulic fluid chamber 140 for moving the piston 98 in a forward direction. An inner periphery of the first cylinder 94 and an outer periphery of the second cylinder 100 define therebetween a hydraulic fluid chamber 142 for moving the piston 98 in a rearward direction. The piston 98 which is formed with hydraulic fluid passageways 144, 146, a hydraulic fluid passageway 148 having a check valve and another hydraulic fluid passageway 150 has attached to its central portion a hollow guide member 152 extending into the third cylinder 104. As shown in FIG. 7, the hydraulic fluid passageways 144, 146 can be opened and closed by a spool 154. As the piston 98 is released from engagement with the stopper 108, the spool 164 is shifted toward the stopper 108 to bring the hydraulic fluid passageways 144 and 146 out of communication with each other. As the piston 98 is brought into engagement with the stopper 108, the spool 154 brings the hydraulic fluid passageways 144, 146 into communication with each other. The hydraulic fluid passageway 150 is communicated with the interior of the hollow guide member 152.

The third hydraulic cylinder 104, pump piston 90 and the second drive piston 102 constitute a unitary structure. As shown in FIG. 6, a rearward end face of the piston 102 and a forward end face of the first drive piston 98 for the second cylinder 100 define therebetween a hydraulic fluid chamber 156 for moving the piston 102 in a forward direction, and an inner periphery of the second cylinder 100 and an outer periphery of the third cylinder 104 define therebetween a hydraulic fluid chamber 158 for moving the piston 102 in a rearward direction. A hydraulic fluid aperture 162 communicating an inner chamber 160 of the cylinder 104 with the hydraulic fluid chamber 158 for moving the piston 102 in the rearward direction is formed in a portion of the third cylinder 104 near its rearward end. The piston 102 moves in sliding movement along the guide member 152 while being sealed in the second cylinder 100.

The first, second ports 134 and 136 of the first hydraulic cylinder 94 are connected through lines 164, 166 (see FIG. 5) to a hydraulic fluid circuit which is connected to a hydraulic fluid source, not shown, for supplying a hydraulic fluid to the ports 134, 136 and mounts therein switching means, not shown, for switching the ports 134, 136 to supply and discharge the hydraulic fluid therethrough. As the hydraulic fluid is supplied from the source through the circuit and the port 134 into the hydraulic fluid chamber 140, the hydraulic fluid forces the first drive piston 98 in a forward direction to move the closing cylinder 88 forwardly to close the soil particles supply port 84 of the soil particle conveying pipe 84. At this time, the piston 98 is brought into contact with the stopper 108 to shift the spool 154 to bring the hydraulic fluid passageways 144 and 146 into communication with each other. This allows the hydraulic fluid to flow from the hydraulic fluid chamber 140 to the hydraulic fluid chamber 156 through the passageways 144 and 146 and forces the second drive piston 102 to move in a forward direction thereby to move the piston 90 forwardly. When pumping of the soil particles by the piston 90 is finished, the hydraulic fluid supplied from the hydraulic fluid circuit flows through the port 136 into the hydraulic fluid chamber 142 and moves the first drive piston 98 in a rearward direction to move the closing cylinder 88 also in a rearward direction. At the same time, the hydraulic fluid flows from the hydraulic fluid chamber 142 through the hydraulic fluid passageway 150, the interior of the guide member 152, the inner chamber 160 of the third cylinder 104 and the aperture 162 into the chamber 158 and moves the second drive piston 102 in a rearward direction to move the pump piston 90 also in a rearward direction.

The soil particle pumping and conveying means 72 of the embodiment shown in FIGS. 5–10 operates as follows.

Figure 8:
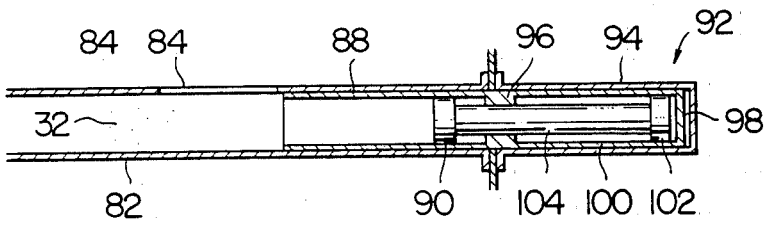
FIG. 8 is a partial schematic cross-sectional view of the soil pumping and conveying means of FIG. 6 in an initial mode in which a closing cylinder and pump piston are both in a rearward position and the soil particle outlet port is being opened.

When the second and third hydraulic cylinders 100, 104 are in their rearward positions and the closing cylinder 88 and pump piston 90 are also in their rearward positions as shown in FIGS. 6 and 8, the soil particle supply port 84 formed in the soil particle conveying pipe 82 is being opened to allow the soil particles in the reservoir 118 to be supplied to the interior of the pipe 82.

Figure 9:
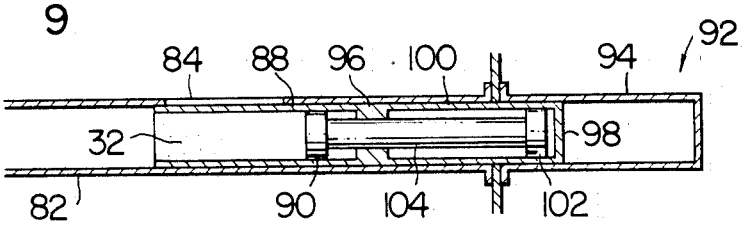
FIG. 9 is a partially schematic cross-sectional view of the soil pump and conveying means of FIG. 6 in an intermediate mode of operation in which the closing cylinder is in a forward position to close the soil particle inlet port.

When the viscosity imparting liquid 32 containing soil particles is supplied to the interior of the pipe 82 as aforesaid, the hydraulic fluid circuit is acutuated to first supply a hydraulic fluid through the port 134 to the hydraulic fluid chamber 140 to move the first drive piston 98 in the forward direction thereby to move the closing cylinder 88 forwardly so as to close the soil particles supply port 84 as shown in FIG. 9. At the same time, the viscosity imparting liquid 32 in the pipe 82 is forced to be stored in the closing cylinder 88 and the piston 98 comes to a halt by abutting against the stopper 108. The hydraulic fluid in the chamber 142 is discharged through the port 136.

Figure 10:
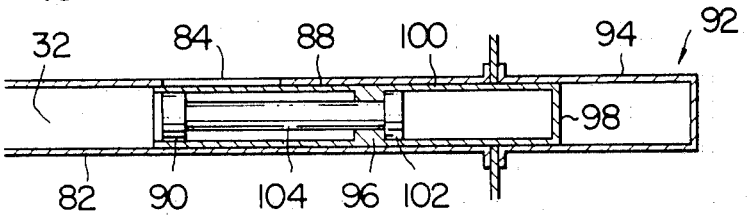
FIG. 10 is a partially scehmatic cross-sectional view of the soil pumping and conveying means of FIG. 6 in a final mode of operation in which the pump piston is also in a forward position to force the soil particles out of the soil particles container.

When the soil particle supply port 84 is closed by the closing cylinder 88, the spool 154 is shifted by the stopper 106 to bring the hydraulic fluid passageways 144 and 146 into communication with each other. As a result, hydraulic fluid flows from chamber 140 through the passageways 133 and 146 to the chamber 156, to move the second drive piston 102 in the forward direction. This moves the pump piston 90 in the forward direction so that the soil particles stored in the closing cylinder 88 are conveyed under pressure and the second drive piston 102 moves to a halt by abutting against the stopper 110 as shown in FIG. 10. The hydraulic fluid in the chamber 158 flows through the aperture 162, the inner chamber 160 of the third hydraulic cylinder 104, the interior of the guide member 152, passageway 150 and chamber 142 and discharged through the port 136.

After the viscosity imparting liquid 32 is discharged from the closing cylinder 88, the direction in which the hydraulic fluid is supplied from the circuit is switched and a hydraulic fluid is supplied through the port 136 to the hydraulic fluid chamber 142 to move the first drive piston 98 rearwardly to move the closing cylinder 88 rearwardly and open the soil particles supply port 84 in the pipe 82 again. The hydraulic fluid in the chamber 140 between the rearward end walls of the piston 98 and the first hydraulic cylinder 94 is discharged through the port 134. As the piston 98 is released from the stopper 108, the spool 154 is shifted by the hydraulic fluid to bring the passageways 144, and 146 out of communication with each other.

Then, the hydraulic fluid is supplied from the chamber 142 through the interior of the guide member 152, the inner chamber 160 of the third hydraulic cylinder 104 and the aperture 162 to the chamber 158 to move the second drive piston 102 rearwardly to move the pump piston 90 and restores the parts to the original positions shown in FIGS. 6 and 8. Meanwhile, the hydraulic fluid in the chamber 156 between the second drive piston 102 and the first drive piston 98 flows through the hydraulic fluid passageway 148 having the check valve and the chamber 140 and is discharged through the port 134.

By repeatedly performing the aforesaid operation, it is possible to positively convey the soil particles even if the soil particles contain solid particles of a relatively large size while the size of the pump unit is made compact.

What is claimed is:

1. A pipe laying apparatus comprising: excavator means for forming a substantially horizontally extending hole in the earth, said excavator means having connected to a trailing end thereof a leading end of at least one underground pipe at least partially located in said horizontally extending hole; injector means for injecting a viscosity imparting liquid into the earth in which evacuation is being performed by the evacuator means to produce viscosity imparting liquid containing soil particles, propulsion means positioned against a trailing end of the pipe and located in a starting pit whereby, said viscosity imparting liquid containing soil particles produced by said evacuator means are conveyed rearwardly of the excavator means past an outer periphery thereof and filled in an annular gap defined between the horizontally extending hole and the pipe while said excavator means and pipe are advanced by said propulsion means; soil particle discharging means located between the trailing edge of said excavator means and the leading end of said pipe and within said pipe for introducing into said pipe the viscosity imparting liquid containing soil particles conveyed rearwardly of the excavator means past the outer periphery thereof and discharging the soil particles into the starting pit through said pipe; said excavator means including an excavator main body and rotary excavating tool means rotatably mounted at a forward end of said excavator main body, said excavator main body having drive means mounted therein for rotatably driving said tool means, said drive means including a hollow rotary drive shaft connected to said rotary excavating tool means for driving thereof; and conduit means for supplying said viscosity imparting liquid to said injector means, said conduit means including said hollow rotary drive shaft opening at one end outside said excavator main body so as to communicate with the injector means whereby the hollow rotary drive shaft is commonly used for forming a portion of the conduit means.

2. A pipe laying apparatus as claimed in claim 1, wherein said conduit means further includes a swivel joint connected at the other end of said hollow rotary drive shaft, and a viscosity imparting liquid supply tube connected at one end to said swivel joint and connected at the other end to a supply source of the viscosity imparting liquid.

3. A pipe laying apparatus as claimed in claim 1, wherein said evacuator main body includes large and small diameter portions alternately arranged in a circumferential direction thereof so as to define a plurality of channels therebetween extending in a longitudinal direction thereof and opening at opposed ends of each channel, said rotary excavating tool means having an outer diameter greater than an outer diameter of the pipe and said large diameter portions of the excavator main body having an outer diameter substantially equal to the rotary excavating tool means whereby the viscosity imparting liquid produced by said rotary evacuation tool means and said ejector means can be conveyed rearwardly of the excavator means through said channels while allowing the large diameter portions of the excavator main body to provide additional spaces within the escavator main body.

4. A pipe laying apparatus comprising: excavator means for forming a substantially horizontally extending hole in the earth, said excavator means having connected to a trailing end thereof the leading end of at least one underground pipe at least partially located in said horizontally extending hole; injector means for injecting a viscosity imparting liquid into the earth in which excavation is being performed by the excavator means to produce viscosity imparted liquid containing soil particles, propulsion means positioned against a trailing end of the pipe and located in a starting pit whereby, said viscosity imparting liquid containing soil particles produced by said excavator means and injector means are conveyed rearwardly of the excavator means past an outer periphery thereof and filled in an annular gap defined between the horizontally extending hole and the pipe while said excavator means and pipe are advanced by said propulsion means; soil particle discharging means located between the trailing end of said excavator means and the leading end of said pipe and within said pipe for introducing into said pipe the viscosity imparted liquid containing soil particles conveyed rearwardly of the excavator means past the outer periphery thereof and discharging the soil particles into the starting pit through said pipe; said excavator means including an excavator main body and rotary excavating tool means rotatably mounted at a forward end of said excavator main body, said excavator main body further including large and small diameter portions alternately arranged in a circumferential direction thereof so as to define a plurality of channels therebetween extending in a longitudinal direction thereof and opening at opposed ends of each channel, said rotary excavating tool means having an outer diameter greater than an outer diameter of the pipe and said large diameter portions of the excavator main portion having an outer diameter substantially equal to the rotary excavating tool means, whereby said viscosity imparting liquid containing soil particles produced by said rotary excavator tool means and said injector means can be conveyed rearwardly of the excavator means through said channels while allowing the large diameter portions of the excavator main body to provide additional spaces within the excavator main body.

5. A pipe laying apparatus as claimed in one of claims 1 or 4, further comprising pressure bearing frame means disposed adjacent said starting pit for closing said annular gap defined between the horizontally extending hole and the pipe at an end thereof disposed on the sides of the starting pit to hold under pressure the viscosity imparting liquid filled in the annular gap.

6. A pipe laying apparatus as claimed in claim 5, further comprising detector means disposed adjacent said discharging means for measuring the pressure of the viscosity imparting liquid to maintain the pressure of the soil particles in the annular gap closed by said pressure bearing frame means over a predetermined level.

7. A pipe laying apparatus as claimed in one of claims 1 or 4, wherein said soil particle discharging means comprises soil particle pumping and conveying means located between the trailing end of the excavator means and the leading end of the pipe for introducing the viscosity imparting liquid into the pipe, and conduit means connected to the soil particle pumping and conveying means and extending through the pipe to the starting pit for discharging the introduced soil particles into the starting pit.

8. A pipe laying apparatus as claimed in claim 7, wherein said soil particle pumping and conveying means comprises an outer shell casing connected between the trailing end of the excavator means and the leading end of the pipe, and pump means arranged in the outer shell casing, said outer shell casing being formed with an inlet opening for introducing the viscosity imparting liquid to the pump means.

9. A pipe laying apparatus as claimed in claim 8, wherein said rotary excavating tool means has an outer diameter greater than the outer diameter of the pipe, and wherein said outer shell casing has a substantially cylindrical form and is substantially equal in outer diameter to the pipe.

10. A pipe laying apparatus as claimed in claim 8, wherein said pipe means comprises a soil particle container secured in place in the outer shell casing and formed with a soil particle inlet port and a soil particle outlet port, closing means including closing cylinder means disposed for reciprocatory movement in the soil particle container across the soil particle inlet port for opening and closing the inlet port, pump piston means disclosed for reciprocatory movement in the closing means in an axial direction thereof for pumping and conveying the soil in particle container, and fluid operated means for forwardly moving the closing means ahead of the pump piston means and forwardly moving the pump piston means after closing of the soil particle inlet port by said closing means to force the soil particles out of the soil particle container, and thereafter moving the closing means and pump piston means rearwardly.

11. A pipe laying apparatus comprising: excavator means for forming a substantially horizontally extending hole in the earth, said excavator means having connected to a trailing end thereof a leading end of a least one underground pipe at least partially located in said horizontally extending hole; injector means for injecting a viscosity imparting liquid into the earth in which the excavation is being performed by the excavator means to produce viscosity imparting liquid containing soil particles; proportion means positioned against a trailing end of the pipe and located in a starting pit whereby, said viscosity imparting liquid containing soil particles produced by said excavator means and injector means are conveyed rearwardly of the excavator means past an outer periphery thereof and filled in an annular gap defined between the horizontally extending hole and the pipe while said excavator means and pipe are advanced by said propulsion means; soil particle discharging means located between the trailing end of said excavator means and the leading end of said pipe and within said pipe for introducing into said pipe the viscosity imparted liquid containing soil particles conveyed rearwardly of the excavator means past the outer periphery thereof and discharging the soil particles into the starting pit through said pipe, said soil particle discharging means including an outer shell casing connected between the trailing end of the excavator means and the leading end of the pipe, and pump means arranged in the outer shell casing, said outer shell casing being formed with an inlet opening for introducing the viscosity imparted liquid containing soil particles to the pump means; said pump means including a cylindrical soil particle container secured in the outer shell casing to extend in a longitudinal direction thereof and formed with a soil particle inlet port and a soil particle outlet port, closing means having a closing cylinder disposed for reciprocatory movement in the soil particle container in an axial direction thereof across the soil particle inlet port for opening and closing thereof, pump piston means disposed in the closing cylinder for reciprocatory movement therein in an axial direction thereof for pumping and conveying the soil in the soil particle container, and fluid operated means for forwardly moving the closing cylinder ahead of the pump piston means and forwardly moving the pump piston means after closing of the solid particle inlet port by said closing cylinder to force the soil particles in the soil particle container to be discharged out of the container, and thereafter moving the closing cylinder and the pump piston means rearwardly.

12. A pipe laying apparatus as claimed in claim 11, wherein said fluid operated means comprises first fluid cylinder means secured in the outer shell casing substantially coaxially with the soil particles container and formed with inlet and outlet ports for a working fluid, second fluid cylinder means connected at one end thereof to the closing cylinder means substantially coaxially therewith and at the other end thereof to first drive piston means disposed for reciprocatory movement in the first fluid cylinder means, and third fluid cylinder means connected at one end thereof to the pump piston means substantially coaxially therewith and at the other end thereof to second drive piston means disposed for reciprocatory movement in the second fluid cylinder means.

* * * * *